US009888757B2

(12) United States Patent
Grieshaber et al.

(10) Patent No.: US 9,888,757 B2
(45) Date of Patent: Feb. 13, 2018

(54) EPILATOR

(71) Applicant: Braun GmbH, Kronberg (DE)

(72) Inventors: Frieder Grieshaber, Neu-Anspach (DE); Tarik Mehaddene, Karben (DE); Bernhard Kraus, Braunfels (DE); Luis Burrell-Diez, Frankfurt am Main (DE); Andreas Lennartz, Kressbronn (DE); Tobias Schwarz, Schmitten (DE); Markus Halm, Koenigstein (DE)

(73) Assignee: Braun GmbH, Kronberg (DE)

( * ) Notice: Subject to any disclaimer, the term of this patent is extended or adjusted under 35 U.S.C. 154(b) by 272 days.

(21) Appl. No.: 14/051,554

(22) Filed: Oct. 11, 2013

(65) Prior Publication Data

US 2014/0107669 A1 Apr. 17, 2014

(30) Foreign Application Priority Data

Oct. 12, 2012 (EP) ..... 12188286

(51) Int. Cl.
*A61B 17/50* (2006.01)
*A45D 26/00* (2006.01)

(52) U.S. Cl.
CPC ..... *A45D 26/0038* (2013.01); *A45D 26/0023* (2013.01); *A45D 26/0028* (2013.01)

(58) Field of Classification Search
CPC ..... A45D 26/0023; A45D 26/0028; A45D 26/0033; A45D 26/0038
USPC ..... 606/131, 133
See application file for complete search history.

(56) References Cited

U.S. PATENT DOCUMENTS

| | | | | |
|---|---|---|---|---|
| 5,312,419 | A | 5/1994 | Garenfeld et al. | |
| 6,287,190 | B1 * | 9/2001 | Inoue | A45D 26/0023 452/82 |
| 2002/0052611 | A1 | 5/2002 | Inoue et al. | |
| 2005/0101971 | A1 | 5/2005 | Lau et al. | |
| 2005/0125008 | A1 * | 6/2005 | Poran | A45D 26/0028 606/133 |

(Continued)

OTHER PUBLICATIONS

U.S. Appl. No. 14/051,590, filed Oct. 11, 2013, Frieder Grieshaber et al.

(Continued)

*Primary Examiner* — Diane Yabut
*Assistant Examiner* — Martin T Ton
(74) *Attorney, Agent, or Firm* — Ronald T. Sia; Kevin C. Johnson; Steven W. Miller

(57) ABSTRACT

An attachment for an epilator or an epilator having at least a clamping unit for clamping and plucking hairs that is arranged for driven movement relative to a housing along a hair capture direction is disclosed. The clamping unit has a moveable clamping element having a clamping surface and a hair guiding surface and a fixed clamping element having a clamping surface and a hair guiding surfaced. The moveable clamping element and the fixed clamping element are arranged to be cyclically moveable between an open position in which the two clamping surfaces have a minimal distance such that a gap for receiving hairs is formed between them and a closed position in which the two clamping surfaces abut on each other. The two hair guiding surfaces form a funnel in front of the gap in the open position with respect to the hair capture direction.

19 Claims, 6 Drawing Sheets

(56) References Cited

U.S. PATENT DOCUMENTS

| | | | | |
|---|---|---|---|---|
| 2005/0273118 | A1* | 12/2005 | Hillenmeier ..... | A45D 26/0028 606/133 |
| 2006/0271071 | A1 | 11/2006 | Dorber et al. | |
| 2008/0269780 | A1 | 10/2008 | Damaschke et al. | |
| 2010/0076457 | A1* | 3/2010 | Inoue ..... | A45D 26/0028 606/133 |
| 2010/0280527 | A1 | 11/2010 | Huisinga et al. | |
| 2012/0165833 | A1 | 6/2012 | Huisinga et al. | |

OTHER PUBLICATIONS

U.S. Appl. No. 14/051,597, filed Oct. 11, 2013, Frieder Grieshaber et al.
European Search Report dated Feb. 14, 2013, 12 pages.

* cited by examiner

EPILATOR

FIELD OF THE INVENTION

The present invention is concerned with an attachment for an epilator and an epilator.

BACKGROUND OF THE INVENTION

It is known that epilators may comprise a clamping cylinder on which clamping units comprising two clamping elements are arranged. During operation, the clamping cylinder is driven into rotation around its cylinder axis. The clamping units are arranged to be cyclically moved between an open position in which a gap extends between the two clamping elements into which gap hairs can enter and a closed position in which the two clamping element abut on each other at least along a clamping line such that hairs that are clamped in between the clamping elements are plucked from the user's skin when the clamping unit continues to rotate on the clamping cylinder while being in the closed position. EP 1 796 501 B1 generally describes a clamping cylinder having a plurality of clamping units.

It is a general desire to increase the efficiency of epilators, i.e. to increase the number of hairs that are clamped and plucked.

It is hence an object of the present disclosure to provide an attachment for an epilator and an epilator having an increased clamping and plucking efficiency over the known devices.

SUMMARY OF THE INVENTION

In accordance with one aspect there is provided an attachment for an epilator or an epilator comprising at least a clamping unit for clamping and plucking hairs, the clamping unit being arranged for driven movement along a hair capture direction, the clamping unit comprising a moveable clamping element having a clamping section and at least a winged section, wherein the clamping section has a clamping surface and the winged section has a guiding surface, which guiding surface angles outwards away from the clamping surface at least with respect to the hair capture direction; and a fixed clamping element having a clamping section and at least a winged section, wherein the clamping section has a clamping surface and the winged section has a guiding surface, which guiding surface angles outwards away from the clamping surface at least with respect to the hair capture direction; wherein the clamping unit is arranged for cyclical movement between an open position in which a gap for receiving hairs and having a minimum width in a width direction perpendicular to the hair capture direction extends between the clamping surfaces of the moveable clamping element and the fixed clamping element and a closed position in which the clamping surfaces of the moveable clamping element and the fixed clamping element abut on each other at least along a clamping line; and wherein the guiding surface of the moveable clamping element defines a first side of a funnel for guiding hairs towards the gap and the guiding surface of the fixed clamping element defines a second side of the funnel, wherein the width of the hair guiding surface of the fixed clamping element measured in a width direction perpendicular to the hair capture direction is larger than the respective width of the hair guiding surface of the moveable clamping element.

In accordance with one aspect there is provided an attachment for an epilator or an epilator, optionally in accordance with any other aspect of the present disclosure, comprising at least a clamping unit comprising a clamping element having a clamping section having a clamping surface and a winged section having a guiding surface that angles away from the clamping surface for guiding hairs, wherein the guiding surface has a three-dimensional shape wherein the guiding surface is inclined (for plane and or curved surfaces) or bent (for curved surfaces) in two different directions. Thus the guiding surface extends in a twisted way or is at least in two directions inclined.

In accordance with one aspect there is provided an attachment for an epilator or an epilator, optionally in accordance with any other aspect of the present disclosure, comprising at least a clamping unit comprising at least a moveable clamping element having a clamping section having a clamping surface and a winged section having a guiding surface that angles outwardly away from the clamping surface, wherein the winged section is pre-stressed such that it angles away from the clamping section in an unconstrained situation at a predetermined angle and is flexibly or pivotably arranged such that the angle with which the winged section angles away from the clamping element can be modified by applying a force onto the winged section in a direction that acts against the pre-stress force.

In accordance with one aspect there is provided an attachment for an epilator or an epilator, optionally in accordance with any other aspect of the present disclosure, comprising at least a clamping unit, the clamping unit having a movable clamping element having a clamping surface and a second clamping element having a clamping surface that are arranged to be cyclically movable with a closure velocity between an open position in which a gap having a minimal width extends between the two clamping surfaces and a closed position in which the clamping surfaces abut on each other over a length, which clamping unit is arranged to be movable at a movement velocity relative to a housing of the epilator, wherein the effective hair catching area of the clamping unit in relation to the closure time is at least 3500 $mm^2/s$, in particular wherein the effective hair catching area of the clamping unit in relation to the closure time is at least 4000 $mm^2/s$, further in particular wherein the effective hair catching area of the clamping unit in relation to the closure time is at least 4500 $mm^2/s$.

In accordance with one aspect there is provided an attachment for an epilator or an epilator comprising at least a clamping unit for clamping and plucking hairs that is arranged for driven movement relative to a housing of the epilator along a hair capture direction, the clamping unit comprising a moveable clamping element having a clamping surface and a hair guiding surface and a fixed clamping element having a clamping surface and a hair guiding surface, wherein the moveable clamping element and the fixed clamping element are arranged to be cyclically moveable between an open position in which the two clamping surfaces have a minimal distance such that a gap for receiving hairs is formed between them and a closed position in which the two clamping surfaces abut on each other, wherein the two hair guiding surfaces form a funnel in front of the gap in the open position with respect to the hair capture direction, which funnel has a width measured in a width direction perpendicular to the hair capture direction, which funnel width is given by the sum of the width of the hair guiding surface of the moveable clamping element, the gap width, and the width of the hair guiding surface of the fixed clamping element, wherein the width of the hair guiding surface of the fixed clamping element is larger than the width of the hair guiding surface of the moveable clamping element, optionally wherein the width of the hair guiding surface of the fixed clamping element is about as large as the sum of the width of the hair guiding surface of the moveable clamping element and the gap width.

BRIEF DESCRIPTION OF THE DRAWINGS

The present disclosure will be further elucidated by a detailed description of example embodiments and with reference to figures. In the figures.

DETAILED DESCRIPTION OF THE INVENTION

Figure 1:
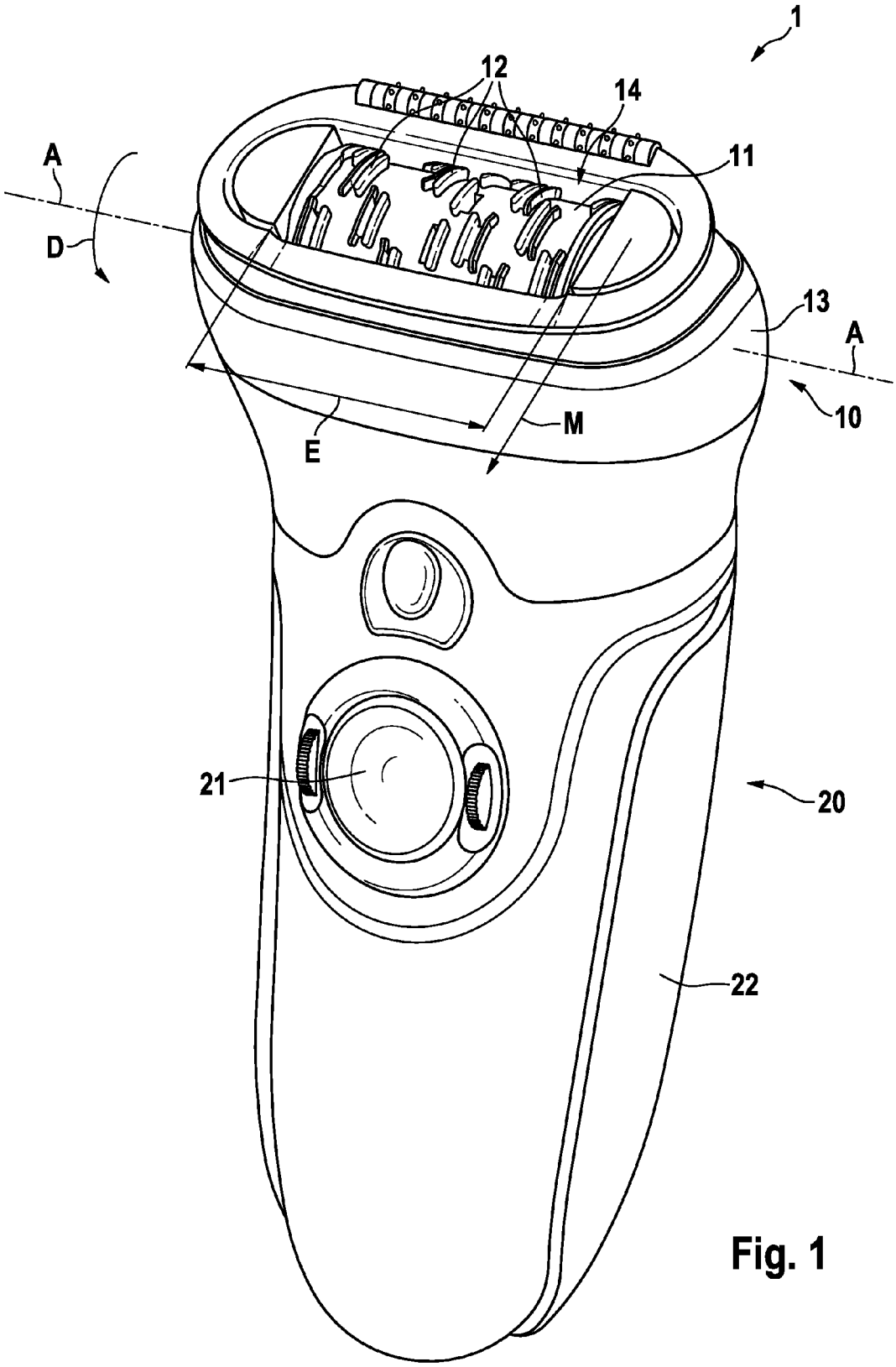
FIG. 1 is a generic depiction of an epilator comprising an attachment and a housing section.

An attachment for an epilator or an epilator in accordance with any aspect of the present disclosure may in particular comprise a carrier, e.g. a clamping cylinder or a clamping disc, on which at least one clamping unit is arranged, which clamping unit comprises two clamping elements, at least one of these clamping elements being a moveable clamping element and the other clamping element being either also a moveable clamping element or a fixed clamping element. The clamping unit forms a discrete portion of the perimeter of the clamping cylinder that protrudes from the clamping cylinder. The clamping unit (i.e. the carrier—e.g. a clamping cylinder) may be arranged for driven movement along a hair capture direction. Each of the clamping elements has a clamping section having a clamping surface. The clamping elements of the clamping unit are arranged to be cyclically moveable between an open position in which a free gap having a minimal gap width extends between the clamping surfaces of the clamping elements such that hairs can be fed into the gap (i.e. the clamping surfaces are arranged vis-à-vis) and a closed position in which the clamping surfaces abut on each other at least along a clamping line (as is explained further below, the clamping surfaces may abut on each other also in a laminar manner). Hairs that are clamped between the clamping surfaces in the closed position will eventually be plucked from the skin when the clamping unit continues to be moved along the hair capture direction relative to the skin of a user while being in the closed position. The clamping elements may in particular each comprise a clamping section on which the clamping surface is arranged and a winged section that is arranged in front of the clamping unit with respect to the hair capture direction and on which a guiding surface is arranged. The winged section angles outwardly away from the clamping section with respect to the hair capture direction such that each of the guiding surfaces of the winged sections of the two clamping elements of the clamping unit form one side of a funnel for guiding hairs towards the gap extending between the clamping surfaces while the clamping unit is in the open position and while the clamping unit is being closed, i.e. hairs are guided into the narrowing gap by the guiding surfaces until the gap is closed (i.e. until the gap is so small that hairs do not feed into the gap anymore). The two such formed sides of the funnel each have a width that is measured in a width direction perpendicular to the hair capture direction (wherein the width direction is also essentially perpendicular to the clamping surfaces in the closed position), wherein in particular in accordance with at least one aspect of the present disclosure where the clamping unit comprises a moveable clamping element and a fixed clamping element, the width of the guiding surface of the moveable clamping element is smaller than the width of the guiding surface of the fixed clamping element. In some embodiments, the width of the guiding surface of the fixed clamping element may then be chosen about as large as the sum of the width of the guiding surface of the moveable clamping element plus the width of the gap in the open position.

In some embodiments of an attachment for an epilator or an epilator in accordance with at least one aspect of the present disclosure, a plurality of clamping units is arranged on a clamping cylinder that is arranged for driven movement around its longitudinal centre axis. Thus the clamping unit is arranged on a clamping cylinder rotating around an axis of rotation and the moveable clamping element is moveable in a direction perpendicular to the hair capture direction or in other words in a direction parallel with said axis of rotation (which is the same axis as the clamping cylinder longitudinal centre axis). The width direction is then parallel to the longitudinal cylinder axis. The clamping units may then be arranged such that the gaps of the clamping units in their open positions do not overlap in the longitudinal cylinder direction, i.e. such that the sum of the widths of all gaps of the plurality of clamping units covers an effective width of the clamping cylinder (which is the width over which the clamping cylinder epilates) by less than 100%, in particular less than 90%, less than 80%, less than 70% or less than 65%. Thus the sum of all gaps between the clamping sections of all clamping units is smaller than the total width of the clamping cylinder. In some embodiments, where each of the plurality of clamping units has a funnel formed in front of the clamping unit, the sum of the total widths of all funnels of all clamping units covers the effective width of the clamping cylinder by more than 100%, in particular more than 200%, or more than 300%. Thus a high hair removal efficacy is achieved although less clamping gaps/clamping units are provided.

In some embodiments of an attachment for an epilator or an epilator in accordance with at least one aspect of the present disclosure, at least one clamping unit comprising two clamping elements is arranged on a clamping cylinder and the length along which two clamping elements abut on each other in a closed position of the clamping unit is in a range of between about 8% to 12% of the perimeter of an enveloping cylinder of the clamping cylinder, in particular in a range of between about 8.5% and about 10.5%, further in particular has a value of about 10%.

In some embodiments of an attachment for an epilator or an epilator in accordance with at least one aspect of the present disclosure, a carrier, e.g. a clamping cylinder or a clamping disc, has a lower lying surface not intended for contact with the skin of a user during regular operation, which lower lying surface has a microscopic or macroscopic texture or has a surface coating or surface layer of a friction enhancing material that has an enhanced friction with hair when compared to the friction between the base material from which the carrier is made and hair. The macroscopic texture may in particular be realized as ridges extending in longitudinal cylinder direction, which ridges may have a height in a range of between about 0.02 mm to about 2.0 mm, in particular of between about 0.05 mm to 0.5 mm, further in particular a value of about 0.1 mm. In addition, the circumferential distance between the ridges may lie in a range of between 0.2 mm to about 2.0 mm. The microscopic texture may in particular be achieved by a certain roughness, which may be realized by filling material in the base material, e.g. glass fibers or ceramic particles.

In some embodiments of an attachment for an epilator or an epilator in accordance with at least one aspect of the present disclosure, at least a clamping unit is arranged on a carrier, e.g. a clamping cylinder or a clamping disc, which clamping unit has a clamping element having a clamping section that has a clamping surface and a winged section that has a guiding surface, which guiding surfaces angles outwardly away from the clamping surface (i.e. the winged section angles outwardly away from the clamping section) and wherein the guiding surface has a three-dimensional shape, i.e. the guiding surface does not lie in a plane in a Cartesian coordinate system.

In some embodiments of an attachment for an epilator or an epilator in accordance with at least one aspect of the present disclosure, at least a clamping unit is arranged on a carrier, e.g. a clamping cylinder or a clamping disc, which clamping unit has a moveable clamping element having a clamping section and a winged section, wherein the winged section is flexible or is hinged at the clamping section and wherein the winged section is under a pre-stress such that it outwardly angles away from the clamping section at a preset value in an unconstraint value and wherein the angle with which the winged section angles away from the clamping section can be modified (in particular reduced) by a force acting against the pre-stress. In particular, the force acting against the pre-stress may be provided by a fixed wall element against which a free end of the winged section abuts, while the clamping unit is in an open position and along which fixed wall element the free end of the winged section will glide at least during a part of the movement when the moveable clamping element is moved such that the angle with which the winged section angles away from the clamping section is modified (in particular is increased).

FIG. 1 is a depiction of an example embodiment of an epilator 1 having a detachable attachment 10 and a housing section 20 that can be held in a user's hand. The housing section 20 may comprise an on/off-switch 21 (which may also be used to switch between different speed settings) and/or a grip area 22 that may be made from a (in particular structured) friction-enhanced material, e.g. a thermoplastic elastomer or a natural rubber. The housing section may also comprise a drive and/or an energy source (e.g. an accumulator). In the shown embodiment, the attachment 10 comprises a clamping cylinder 11 having a plurality of clamping units 12. The clamping cylinder 11 is arranged for driven movement around its centre axis A (i.e. the longitudinal cylinder axis) such that the clamping units 12 move along a hair capture direction D. The attachment 10 may comprise a detachable cap unit 13 havening an opening 14 through which the clamping cylinder 11 extends for being brought into contact with a user's skin. The opening 14 defines an effective width E of the clamping cylinder 11 measured in longitudinal cylinder direction, which is the width over which the epilator can clamp and pluck hairs during operation. A user will typically move the epilator over the skin along a movement direction M which coincides with the hair capture direction D. As will be explained in more detail further below, the clamping units 12 each comprise two clamping elements of which at least one clamping element is arranged to be moveable. The clamping elements are arranged for cyclical movement between an open position in which hairs can enter into a gap extending between clamping surfaces of the clamping elements and a closed position in which the clamping surfaces abut on each other at least along a clamping line. As is generally known, hairs that are clamped by the clamping units in the closed position will be eventually plucked from the skin when the clamping unit continues to move along the hair capture direction D while the clamping unit continues being in the closed position. Patent document EP 1 796 501 B1 generally describes an epilator having a clamping cylinder with a plurality of clamping units; the content of said document shall be incorporated herein by reference.

While in FIG. 1 and in the below example embodiments, an epilator or an attachment for an epilator is discussed that has a clamping cylinder carrying the clamping unit, the clamping unit may be arranged at any other carrier arranged for being driven along a hair capture direction. E.g. the clamping unit may be provided at a disc that is arranged for driven rotation around its centre axis.

Figure 2:
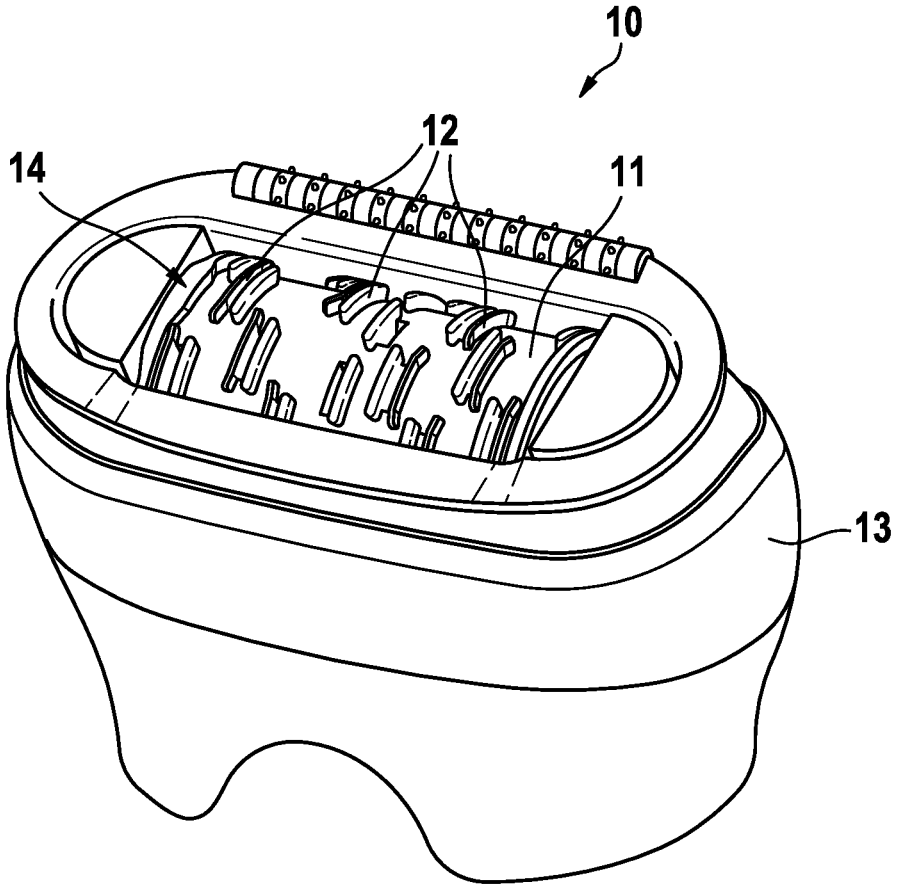
FIG. 2 is a depiction of the attachment shown in FIG. 1 in a detached state.

FIG. 2 shows an example embodiment of an attachment 10 for an epilator shown in its detached state, which attachment 10 is in accordance with the attachment discussed with respect to FIG. 1. While it is here shown that an attachment for an epilator is detachable, this shall not exclude that the features discussed with respect to an attachment can also be realized at an epilator not having a detachable attachment, i.e. where the clamping unit is arranged at a carrier (e.g. a clamping cylinder) at the epilator.

Figure 3:
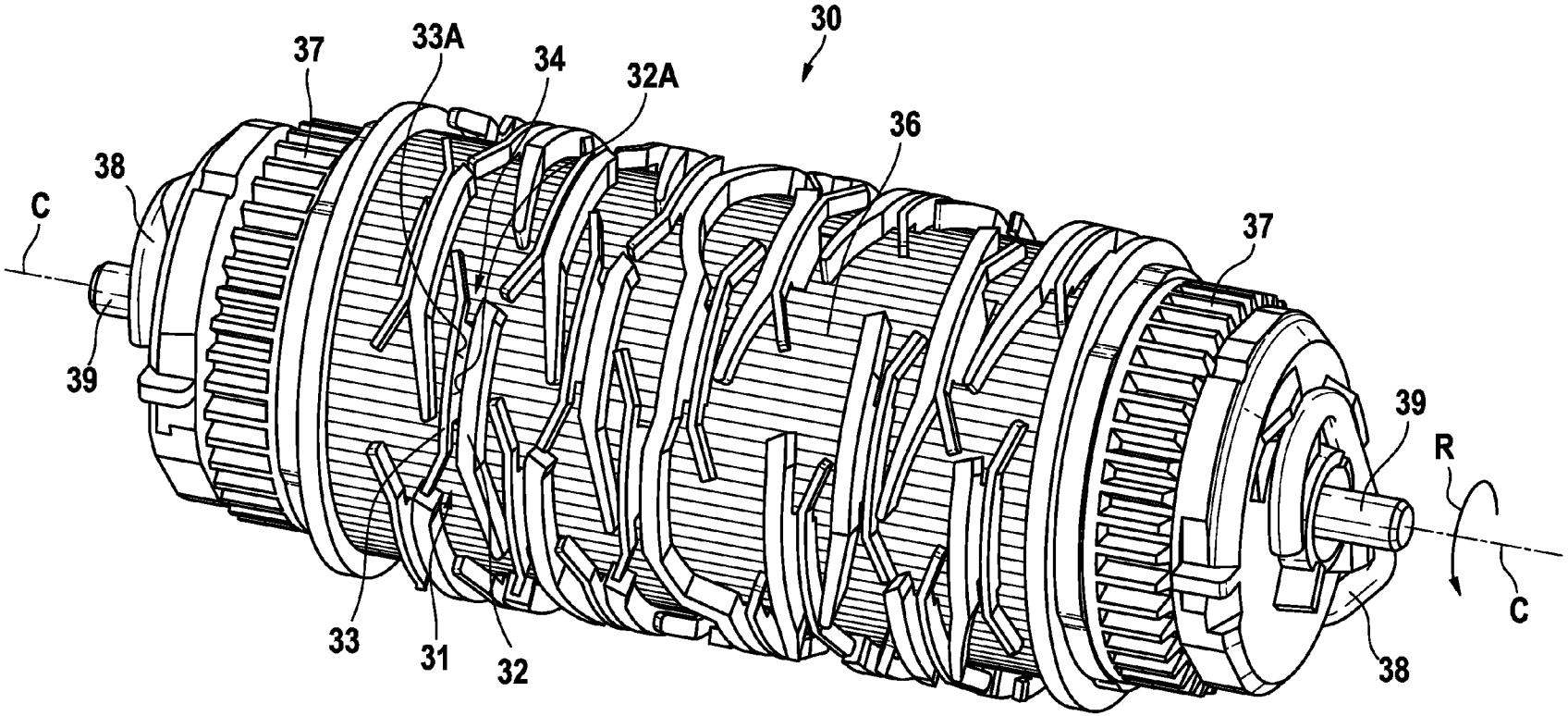
FIG. 3 is a depiction of an example embodiment of a clamping cylinder in accordance with at least one aspect of the present disclosure.

FIG. 3 shows an example embodiment of a clamping cylinder 30 shown in a perspective view. A plurality of clamping units 31 is arranged on the clamping cylinder 30. Each clamping unit 31 comprises a fixed clamping element 32 and a moveable clamping element 33. The fixed clamping elements 32 may be made integral with the clamping cylinder base material, e.g. the fixed clamping units may be made from a plastic material and may be manufactured by a plastic injection molding process together with a part of the clamping cylinder. As has been mentioned before, the clamping elements 32, 33 are arranged for cyclic movement between an open position in which a gap 34 extends between the clamping elements such that hairs can enter into the gap and a closed position in which the clamping elements abut on each other and thus clamp hairs having been in the gap. At least one wing section of one of the moveable or fixed clamping element comprises an outermost arc shaped portion. The clamping section of at least one of the moveable or fixed clamping element comprises also an outermost arc shaped portion. Thus the clamping elements 32, 33 have outer surfaces 32A, 33A that essentially lie on the surface of an enveloping cylinder. The outer surfaces 32A, 33A are intended for contact with a user's skin during operation. A regular pattern of ridges 36 extending in longitudinal cylinder direction on a lower level of the clamping cylinder surface (i.e. on a level of the clamping cylinder below the enveloping cylinder—see FIG. 6) is provided in the shown example embodiment. In some embodiments, the enveloping cylinder may have a diameter of about 19 mm and the cylinder defined by the lower level surface (i.e. the surface that is defined by the top parts of the ridges) may have a diameter of about 17 mm. In some embodiments, the ridges may have a height of about 0.1 mm. The geometry and function of the ridges (or similar structures) will be explained further below in more detail, but such structures as the shown ridges serve to erect hairs that lie close to the skin. The clamping cylinder 30 comprises an axis 39 that may be borne by respective bearings provided at the attachment so that the clamping cylinder 30 is enabled to rotate around its central axis C in rotation direction R. A spring 38 presses the clamping cylinder parts together and provides the clamping force with which the clamping elements are pressed together in their closed position. The clamping cylinder 30 may also comprise at least one gear wheel 37 provided for meshing with a further gear wheel that may be driven during operation, which further gear wheel may be a part of the housing section.

While the example embodiment of a clamping cylinder shown in FIG. 3 has a plurality of clamping elements, it is noted that in accordance with the present disclosure it is sufficient that a clamping cylinder has at least one clamping unit. It is also noted that in case of two or more clamping units, the clamping units may each be different, e.g. one clamping unit may comprise a fixed and a moveable clamping element, another clamping unit may comprise two moveable clamping units. It is also generally noted that all features shown and discussed with respect to an example embodiment do not necessarily need to be seen as disclosed only in that combination but that all features that can be separated without violating the gist and scope of the present disclosure shall be considered as being disclosed independently from all other features. E.g. the ridges provided on the clamping cylinder discussed in connection with FIG. 3 may not only be an optional feature but may indeed be considered as an independent aspect of the present disclosure.

It is noted that in general an epilation cylinder may be equipped with a friction enhanced lower level surface, which friction enhancement (with respect to hairs) may be achieved by macroscopic structures (e.g. ridges as shown in and discussed with respect to FIG. 3) or by microscopic structures (e.g. a certain roughness) or by a material choice providing an increased friction with hairs (e.g. keratin filaments) when compared to the plastic material used for making the clamping cylinder. E.g. the lower level surface of the clamping cylinder may have a coating of an artificial rubber. The friction enhancement of a lower level surface was found to potentially increase the number of hairs that become erected out of a position where they lie close to the skin. Hairs lying close to skin still have a certain elevation above the skin surface. The lower level surface is thus retracted from the enveloping cylinder by a typical value of between about 0.25 mm to about 3.0 mm, in particular of between about 0.5 mm to 1.5 mm, in order to provide a good hair erection effectiveness. With additional hairs being erect, the efficiency of the epilator is likely to be increased. Whether the enhanced friction of the lower level surface of the epilator is provided by microscopic or macroscopic structures realized in the base material of the clamping cylinder or by a coating or layer of a different material covering the lower level surface, this feature is considered as an independent aspect of the present disclosure, while this feature may also be combined with all other features of the present disclosure.

Figure 4A:
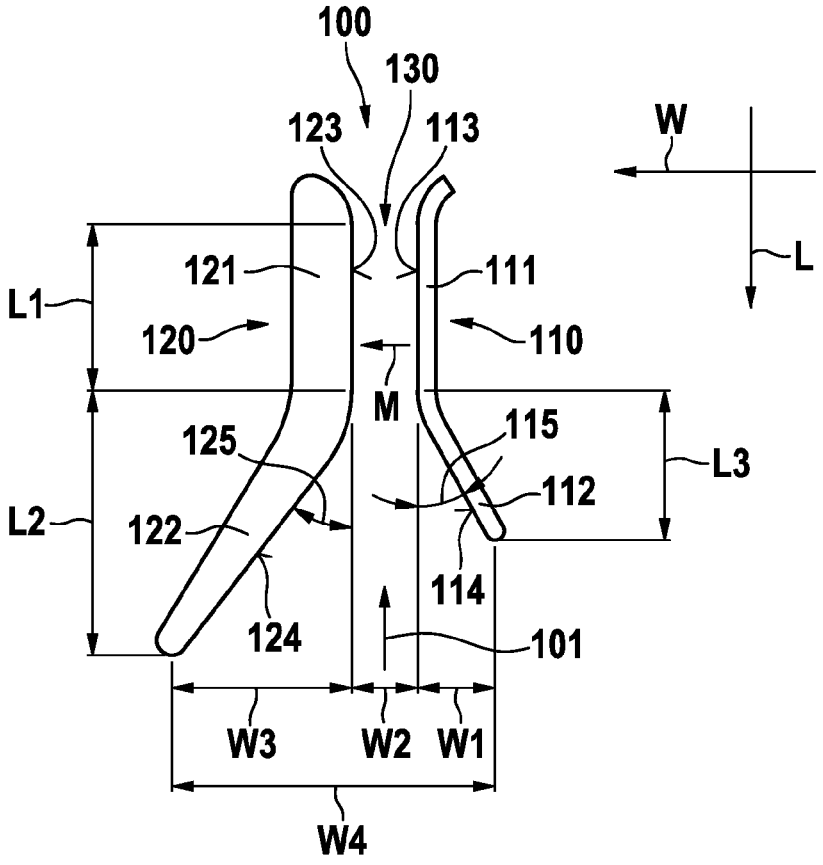
FIG. 4A is a schematic depiction of an example embodiment of a clamping unit in accordance with at least one aspect of the present description shown in an open position.

FIG. 4A shows an example embodiment of a schematically drawn clamping unit 100 shown in an open position, which clamping unit 100 may be arranged on a clamping cylinder as shown in FIG. 3. The clamping unit has a moveable clamping element 110 and a fixed clamping element 120 that are arranged vis-à-vis. The moveable clamping element 110 may be made from a metal sheet such as a stainless steel sheet material, while it should not be excluded that the moveable clamping element may be made from other materials such as plastic or reinforced plastic. The fixed clamping element 120 may be an integral part of at least a part of a clamping cylinder and may be made from a plastic material (e.g. via a plastic injection molding process), in particular from a plastic material that is reinforced by a filling substance such as glass fibers or ceramic particles.

The moveable clamping element 110 has a clamping section 111 and a winged section 112. The clamping section 111 extends in a length direction L with a length L1 and has a clamping surface 113. The length direction L coincides with the hair capture direction (see reference numeral D in FIG. 1) along which the clamping unit 100 will be moved during operation. The fixed clamping element 120 has a clamping section 121 and a winged section 122. The clamping section 121 extends in a length direction L with a length L1 and has a clamping surface 123 that faces the clamping surface 113 of the moveable clamping element 110. The position of the two oppositely arranged clamping elements 110, 120 coincide in length direction L so that in a closed position (FIG. 4B), the effective clamping length is also L1. In the open position as shown in FIG. 4A, a gap 130 extends between the clamping surfaces 113, 123 of the moveable and fixed clamping elements 110, 120. The gap 130 has in the open position a minimal gap width W2 in a width direction W (the width direction W being perpendicular to the length direction L, i.e. the width direction is perpendicular to the hair capture direction). As the clamping sections 111, 121 may not necessarily be parallel to each other in the open position, the minimal gap width W2 may not be the same over the whole gap extension. The minimal gap width W2 is sized such that hairs can feed into the gap. While the diameter of typical human hairs may lie in a range of 80 micrometer±40 micrometer, the gap width W2 may lie in a range of between about 0.1 mm to about 2.0 mm, in particular in a range of between about 0.4 mm to about 1.4 mm. In some embodiments, the minimal gap width W2 may be about 0.6 mm.

The winged section 122 of the fixed clamping element 120 has a guiding surface 124 that outwardly angles away from the clamping surface 123 of the clamping section 121 with an angle 125 such that a first side of a funnel is formed on a front side 101 of the clamping unit 100. The front side 101 of the clamping unit 100 is the side from which hairs approach the clamping unit 100 during operation, when the clamping unit 100 is moved along the hair capture direction that here coincides with the length direction L. The guiding surface 124 of the winged section 122 extends in length direction L over a length L2 and in the width direction W over a width W3. The winged section 112 of the moveable clamping element 110 has a guiding surface 114 that outwardly angles away from the clamping surface 113 of the clamping section 111 with an angle 115 such that a second side of the funnel is formed. The guiding surface 114 of the winged section 112 extends in length direction L over a length L3 and in the width direction W over a width W1. The total effective width W4 over which the clamping unit 100 thus may catch and hence plug hairs is given by the sum of the widths' of the winged sections 112 and 122 and of the gap width W2, W4=W1+W2+W3. The total effective width over which the clamping unit catches hairs may be between 2 mm to 7 mm which is the sum of the widths' of both adjacent winged sections within a clamping unit and of the gap width between both clamping sections in its open position.

As is generally known, the moveable clamping element 120 may be spring loaded such that the clamping unit 100 is in the open position as long as a respective actuator is not forcing the two clamping elements 110, 120 together.

During operation, the clamping unit 100 will be moved relatively to the user's skin such that hairs growing on the skin will approach the clamping unit 100 from the front side 101 of the clamping unit 100 and will be guided by the guiding surfaces 114 and 124 into the gap 130, which gap will be closed until the clamping surfaces 113, 123 are urged together so that hairs in the gap 130 will then be clamped and will eventually be plugged from the skin due to the relative movement between the clamping unit 100 and the user's skin. The relative movement between the clamping unit 100 and the user's skin typically has two components: the usually faster component is provided by the drive of the epilator that drives the clamping unit 100 into motion, e.g. by rotating a clamping cylinder into rotation, and by a usually slower component that is given by the movement the user introduces by manually moving the epilator over the skin. The clamping cylinder may be driven with a number of rotations per minute (rpm) that lie in a range of between about 500 rpm to about 5000 rpm, in particular in a range of between about 1000 rpm to about 2500 rpm. In some embodiments, the clamping cylinder may rotate in a range of between about 1300 rpm to about 1900 rpm.

In some embodiments, the width W3 by which the guiding surface 124 of the fixed clamping element 120 extends in width direction W may be set to a value that allows hairs that are caught at the outer edge of the first side of the funnel to become clamped by the clamping unit. This value may in particular depend on the typical hair length of hairs that will become epilated and a typical time period between epilation events. A typical growth length for hairs growing on human skin is about 0.2 mm per day. A typical period between epilation events may be 2 weeks, i.e. 14 days, so that the hair has grown 2.8 mm between respective epilation events. During epilation, some hairs that are not plucked from the skin typically break about 0.5 mm-10 mm below the skin surface, so that the hair length of the broken hairs above the skin may roughly be in the range of 1.8 mm to 2.3 mm (hairs that are plucked together with at least a part of the hair root require a certain period for growing again as first the hair root needs to be rebuild). Assuming that a certain length of the hair needs to extend into the gap of the clamping unit for reliable epilation, typical values for the width W3 of the guiding surface of the fixed clamping element may thus lie in a range of between about 0.4 mm to about 2.0 mm. As the moveable clamping element 110 moves towards the fixed clamping element 120, the effective width of the second side of the funnel is determined by the sum of the gap width W2 and the width W1 of the guiding surface 114 of the moveable clamping element 110. Thus, a symmetric setting of the funnel widths would require W1 to be set to W3 minus W2, W1=W3−W2. That means that for a symmetric guiding efficiency the winged sections may be asymmetrically realized, e.g. the guiding surface 114 of the winged section 112 of the moveable clamping element 110 may have a shorter width W1 in comparison to the width W3 of the guiding surface 124 of the winged section 122 of the fixed clamping element 120. In other words the fixed clamping unit comprises a winged section that is longer and/or with broader width extension than the winged section of the moveable clamping unit.

In some embodiments, the length L2 of the guiding surface 124 of the winged section 122 of the fixed clamping element 120 may lie in a range of between about 2 mm and about 8 mm and the respective width W3 may be in a range of between about 0.5 mm and about 3.0 mm. In some embodiments, the length L2 may be about 5 mm. In some embodiments, the width W3 may be about 1.5 mm, which may be considered a value that nicely considers the above mentioned hair length of broken hairs after two weeks and thus provides an adapted high efficiency based on the typical hair length. A larger width W3 may increase efficiency further if hairs are longer (e.g. in case that a longer period lies between epilation events), but a larger width w3 also requires more available space on the carrier (e.g. the clamping cylinder) on which the clamping unit is arranged. In some embodiments, the length L3 of the guiding surface 114 of the winged section 112 of the moveable clamping element 110 may be in a range of between about 0.1 mm and about 4.0 mm and the width W1 may be in a range of between about 0.1 mm and about 2.0 mm. In some embodiments, the length L3 may be about 2 mm. In some embodiments, the width W1 may be about 0.8 mm.

In some embodiments, the angle 115 between the clamping surface 113 and the guiding surface 114 of the winged section 112 of the moveable clamping element 110 and/or the angle 125 between the clamping surface 123 and the guiding surface 124 of the winged section 122 of the fixed clamping element 120 may lie in a range of between about 5 degree to about 45 degree, in particular in a range of between about 10 degree to about 30 degree. In some embodiments, the respective angles 115, 125 may be different; in particular, the angle 115 may be larger than the angle 125. In some embodiments, the angle 115 between the clamping surface 113 and the guiding surface 114 of the winged section 112 of the moveable clamping element 110 may be about 22.5 degrees. In some embodiments, the angle 125 between the clamping surface 123 and the guiding surface 124 of the winged section 122 of the fixed clamping element 120 may be about 16 degrees.

In some embodiments, alternatively or additionally the width W3 by which the guiding surface 124 of the fixed clamping element 120 extends in width direction W is about the same as the sum of the minimal gap width W2 and of the width W1 of the guiding surface 114 of the winged section 112 of the moveable clamping element 110, W3≈W1+W2, in particular wherein W3 differs by not more than 10% from W2+W1, optionally by not more than 5%, further in particular where W3 is identical to W1+W2, W3=W1+W2.

Figure 4B:
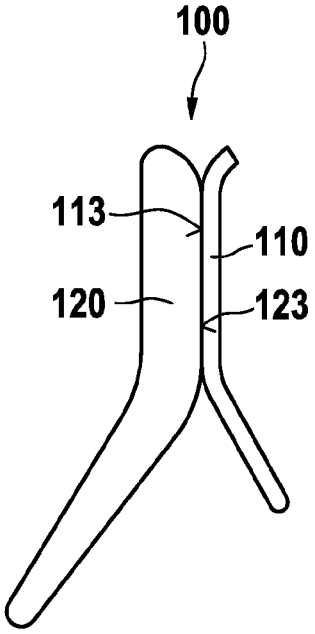
FIG. 4B is a depiction of the clamping unit shown in FIG. 4A in a closed position.

FIG. 4B schematically shows the clamping unit 100 shown in FIG. 4A in its open position in its closed position. In order to reach the closed position, the moveable clamping element 110 is moved generally along a closure direction M as indicated in FIG. 4A towards the fixed clamping element 120 such that in the closed position the clamping surface 113 of the moveable clamping element 110 abuts onto the clamping surface 123 of the fixed clamping element 120 at least along a clamping line, optionally wherein the clamping surfaces 113, 123 abut on each other in a laminar manner. While it may be sufficient that the clamping surfaces only abut on each other along a clamping line, a high pressure may be present along the clamping line and hairs may be cut or may break during the plucking procedure due to this high pressure. Hence, a laminar clamping area may tend to reduce the number of hairs that are cut or that break.

One may define an effective hair catching area A, which is the area from which hairs are clamped by a clamping unit, neglecting the effect of guiding surfaces that may guide hairs from an enlarged area into the gap. The effective hair catching area A is then depending on the clamping length l of the clamping unit, the closure velocity c with which the clamping elements of the clamping unit are closed, the gap width d, and the velocity v with which the clamping unit is moved relative to the skin, so that $A=d(l-\frac{1}{2}v\cdot d/c)$. A typical closure speed c may lie in the range of between about 0.7 m/s to about 1.3 m/s, in particular at about 1 m/s. Thus, the effective hair catching area in relation to the closure time for a closure speed of 1000 $mm^2/s$ for a typical clamping length of 4.0 mm as known from prior art devices, a gap width of 0.9 mm and a movement velocity of 2000 mm/s is 2790 mm/s. The overall hair epilation effectiveness will become increased if the parameters of a clamping unit and the epilator are chosen such that the effective hair catching area in relation to the closure time is at least 3500 $mm^2/s$ or at least 4000 $mm^2/s$ or at least 4500 $mm^2/s$.

Figure 5A:
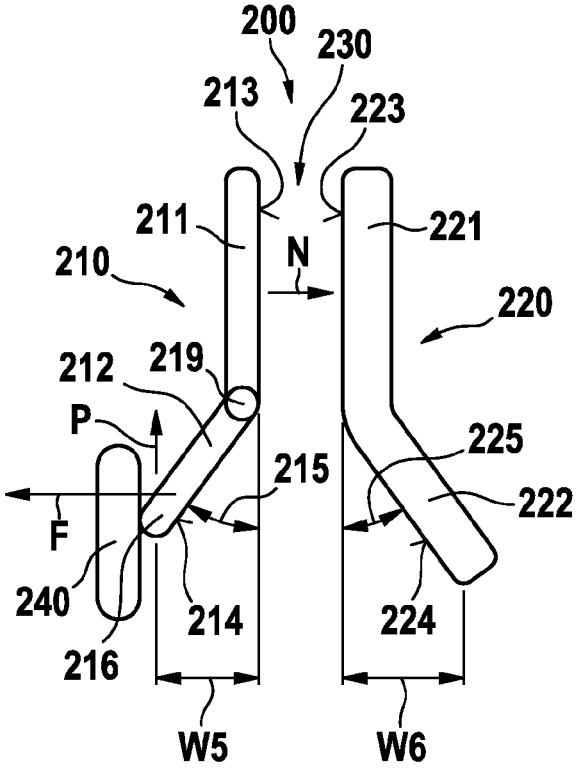
FIG. 5A is a schematic depiction of another example embodiment of a clamping unit in accordance with at least one aspect of the present description shown in an open position.

FIG. 5A is a schematic depiction of a clamping unit 200 of an epilator in accordance with at least an aspect of the present disclosure, which clamping unit 200 is shown in an open position. The clamping unit 200 comprises a moveable clamping element 210 and a fixed clamping element 220. Similarly to the clamping unit 100 shown in FIGS. 4A and 4B, the moveable clamping element has a clamping section 211 and a winged section 212, where the clamping section 211 has a clamping surface 213 and the winged section 212 has a guiding surface 214 that angles outwardly away from the clamping surface 213 at an angle 215. Accordingly, the fixed clamping element 220 has a clamping section 221 and a winged section 222, where the clamping section 221 has a clamping surface 223 and the winged section 222 has a guiding surface 224 that angles outwardly away from the clamping surface 223 at an angle 225. The clamping surfaces 213 and 223 are arranged essentially opposite to each other and are separated in the open position by a gap 230 that is sized to receive hairs. In the shown example embodiment, the winged section 212 of the moveable clamping element 210 is hinged at the clamping section 211 with a hinge 219 and the winged section 211 has a free end 216 that is in contact with a stopper element 240. The hinge 219 may be realized by an elastic material arranged between the clamping section 211 and the winged section 212, which both may be made from a metal sheet material. The winged section 212 is under a pre-stress F such that the angle at which the guiding surface 214 would angle outwardly away from the clamping surface 213 in an unconditioned situation would be larger than angle 215 indicated in FIG. 5A, which angle 215 is determined by the relative position of a stopper element 240 providing a constraint for the winged section 212 to move under the present pre-stress F. As is indicated by arrow N, the moveable clamping element 210 will be moved towards the fixed clamping element 220 in order to achieve the closed position shown in FIG. 5B. When the movable clamping element 210 is moved along direction N, the free end 216 of the winged section 212 of the moveable clamping element 210 will stay in contact with the stopper element 240 due to the acting pre-stress F and will move along direction P.

Figure 5B:
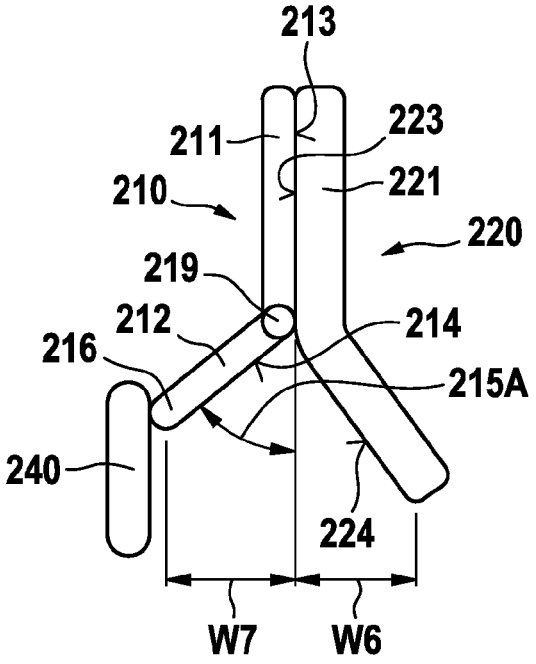
FIG. 5B is a depiction of the clamping unit shown in FIG. 5A in a closed position.

FIG. 5B schematically shows the closed position of the clamping unit 200 shown in FIG. 5A. In the closed position, the clamping surfaces 213, 223 of the moveable and the fixed clamping elements 210, 220 abut on each other at least along a clamping line. In the closed position, the guiding surface 214 of the winged section 212 of the moveable clamping element 210 is angled outwardly away from the clamping surface 213 at an angle 215A that is larger than the angle 21 the respective surfaces have in the open position shown in FIG. 5A.

It is noted that the provision of a winged section of a moveable clamping element being under a pre-stress such that the width of the guiding surface of the winged section increases when the clamping unit is closed is considered as an independent aspect of the present disclosure, while it shall not be excluded that this feature may be combined with all other features described in the present disclosure.

In some embodiments, a plurality of 40 clamping units as shown in FIG. 4A or 5A may be arranged on a clamping cylinder as shown in FIG. 3. The clamping cylinder may have an effective clamping width of 31.9 mm, while the gap width of each clamping unit may be 0.6 mm and the total funnel width of each clamping unit may be about 2.6 mm. Then, assuming that the gaps of the clamping units are arranged on the clamping cylinder such that they do not overlap in longitudinal cylinder axis direction, the total gap width (i.e. the sum of all the 40 gap widths of each 0.6 mm) is 24 mm, which means that the clamping cylinder has a gap coverage of only about 61%. On the other hand, as the added total funnel width of all clamping units is 104 mm, this means that the clamping cylinder is covered by the funnels at about 326%. In other words, each hair growing on the skin may get clamped and plucked by more than three clamping units per revolution of the clamping cylinder. It is considered a general aspect of the present disclosure that the gap coverage of an epilation cylinder is less than 100% while the funnel coverage is above 100%. In particular, the gap coverage may be in a range of between about 20% to about 95% (in particular of between about 50% to about 80%) and additionally or alternatively the funnel coverage may be in a range of about 105% to about 500% (in particular of between about 150% to about 450% and further optionally where the lower funnel coverage value may be at least 200% or even at least 300%). It has been found that a distance between clamping units in longitudinal cylinder axis direction that is larger than the gap width (in particular wherein the distance is at least 25% larger than the gap width or further in particular wherein the distance is at least 30% larger than the gap width) and optionally additionally with a circumferential arrangement of the clamping units such that each clamping unit has a different angular position on the circumference of the clamping cylinder (e.g. in case of 40 clamping units, the angular distance between the clamping units may be 9 degrees) supports the provision of enough space to realize the large funnel widths for the clamping units.

Figure 6:
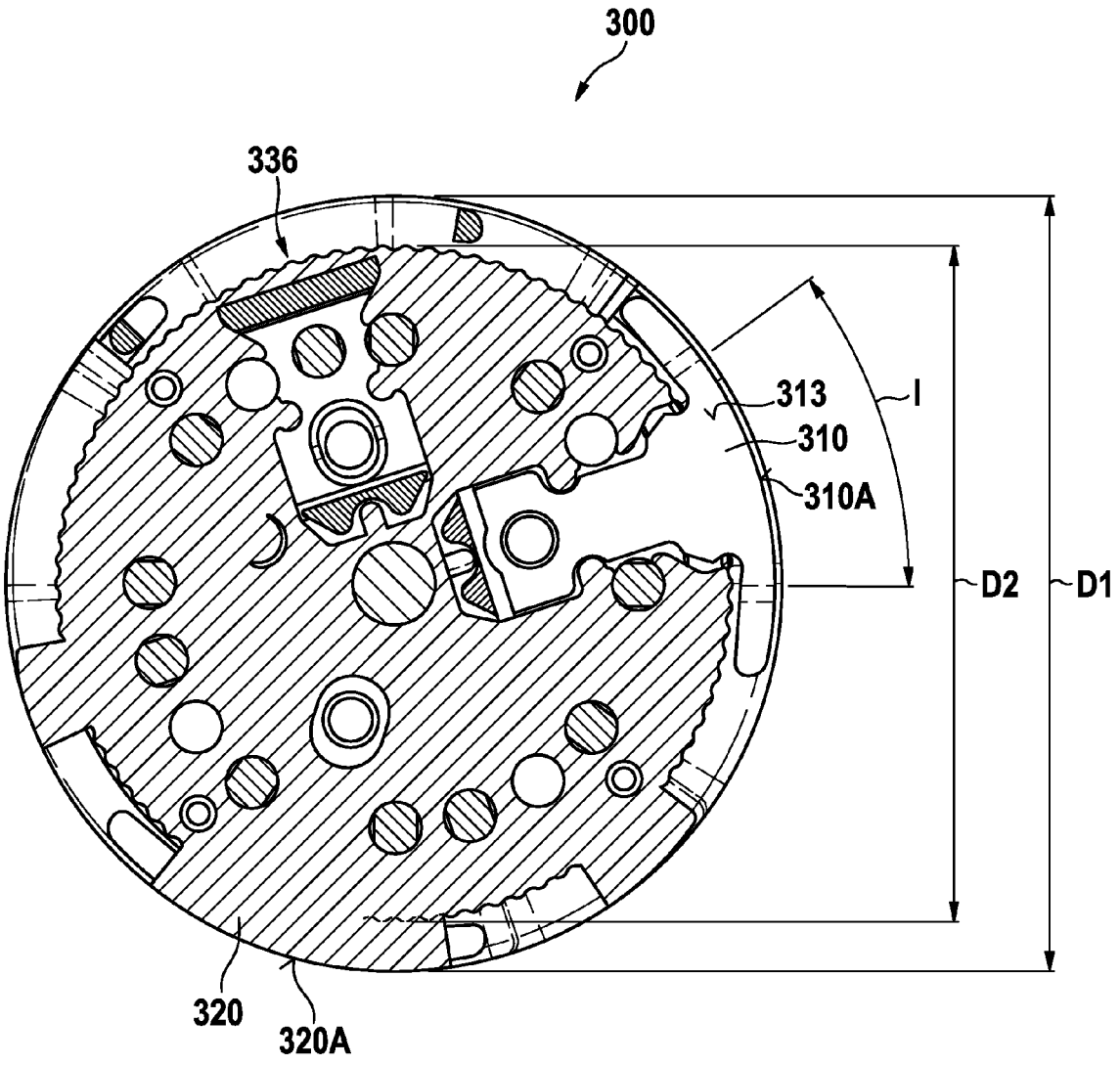
FIG. 6 is a cross sectional cut though a clamping cylinder, the cut taken in a plane being perpendicular to the longitudinal cylinder axis.

FIG. 6 is a cross sectional cut through an example embodiment of a clamping cylinder 300, where the cross sectional cut was taken in a plane perpendicular to the longitudinal cylinder axis. A movable clamping element 310 can be seen that has a clamping surface 313 that extends along a clamping length l (the clamping length l being measured at the top level of the moveable clamping element 310, which top level is defined by the top surface 310A of the moveable clamping element 310, which top surface 310A is intended to contact the skin of a user during operation). It is also noted that in the shown embodiment, the outer surface 310A of the moveable clamping element follows the curvature of the cylinder. Also, three cuts through fixed clamping element parts can be seen, one of which is exemplary identified as fixed clamping element 320 having a top surface 320A intended for contact with the skin of a user during operation. The outer surfaces 310A, 320A lie on an outer enveloping cylinder that has a diameter D1, which diameter D1 may lie in a range of between about 10 mm to about 40 mm. It can further be seen in FIG. 6 that a regular pattern of ridges 336 (which may extend parallel to the cylinder axis as is shown in FIG. 3) is arranged on a lower level cylinder surface, which lower level cylinder is coaxial with the enveloping cylinder and has a diameter D2, where D2<D1. In some embodiments, D2 may be around 80% of D1. In some embodiments, the clamping length l extends over about 36 degrees of the angular range measured from the centre point of the cross sectional cut or in other words, the clamping length l may be about 10% of the perimeter of the outer enveloping cylinder, i.e. $l=0.1\cdot 2\pi\cdot D1/2$. Generally, the clamping length l may be in a range of between about 8% to about 12% of the perimeter of the enveloping cylinder, in particular it may lie in a range of between about 8.5% to about 10.5%. While generally an increase of the clamping length l may increase the efficiency of the clamping cylinder, the clamping element also needs to have contact with the skin over its clamping length as otherwise the efficiency may not further increase due to non-clamped hairs. It has been found that a clamping length of about one tenth of the perimeter of the clamping cylinder defines a compromise between efficiency increase due to length increase and reliable skin contact over the full length extension.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilator comprising:

a clamping cylinder configured to rotate around an axis;

a fixed clamping element disposed on the clamping cylinder, the fixed clamping element having a first clamping section, a first winged section, a second clamping section, and a second winged section, wherein the first winged section angularly extends outwards in a first direction substantially parallel to a longitudinal axis of the clamping cylinder and the second winged section angularly extends outwards in a second direction substantially parallel to the longitudinal axis of the clamping cylinder and opposite the first direction;

a first moveable clamping element disposed on the clamping cylinder, the first moveable clamping element having a clamping section and a winged section, wherein the clamping section of the first moveable element is disposed on the clamping cylinder adjacent to the first clamping section of the fixed clamping element, and wherein the winged section of the first moveable element is disposed on the clamping cylinder adjacent to the first winged section of the fixed clamping element and angularly extends outwards in the second direction forming a first funnel;

a second moveable clamping element disposed on the clamping cylinder, the second moveable clamping element having a clamping section and a winged section, wherein the clamping section of the second moveable element is disposed on the clamping cylinder adjacent to the second clamping section of the fixed clamping element, and wherein the winged section of the second moveable element is disposed on the clamping cylinder adjacent to the second winged section of the fixed clamping element and angularly extends outwards in the first direction forming a second funnel;

wherein the first moveable clamping element is configured for cyclical movement between (i) an open position in which a first gap for receiving hairs extends between the clamping section of the first moveable clamping element and the adjacent first clamping section of the fixed clamping element and (ii) a closed position in which the clamping section of the first moveable clamping element abuts the adjacent first clamping section of the fixed clamping element;

wherein the second moveable clamping element is configured for cyclical movement between (i) an open position in which a second gap for receiving hairs extends between the clamping section of the second moveable clamping element and the adjacent second clamping section of the fixed clamping element and (ii) a closed position in which the clamping section of the second moveable clamping element abuts the adjacent second clamping section of the fixed clamping element; and wherein the first funnel is configured for guiding hairs towards the first gap and the second funnel is configured for guiding hairs towards the second gap.

2. The epilator in accordance with claim 1, wherein the first clamping section of the fixed clamping element, the first winged section of the fixed clamping element, the clamping section of the first moveable clamping element, and the winged section of the first moveable clamping element form a first clamping unit; and wherein the second clamping section of the fixed clamping element, the second winged section of the fixed clamping element, the clamping section of the second moveable clamping element, and the winged section of the second moveable clamping element form a second clamping unit.

3. The epilator in accordance with claim 2, wherein a width of the first clamping section of the fixed clamping element measured in a width direction substantially parallel to the longitudinal axis of the clamping cylinder is larger than a width of the clamping section of the first moveable clamping element measured in a width direction substantially parallel to the longitudinal axis of the clamping cylinder; and wherein a width of the second clamping section of the fixed clamping element measured in a width direction substantially parallel to the longitudinal axis of the clamping cylinder is larger than a width of the clamping section of the second moveable clamping element measured in a width direction substantially parallel to the longitudinal axis of the clamping cylinder.

4. The epilator in accordance with claim 3, wherein the width of the first clamping section of the fixed clamping element is about as large as the sum of the width of the clamping section of the first moveable clamping element and the width of the first gap in the open position; and wherein the width of the second clamping section of the fixed clamping element is about as large as the sum of the width of the clamping section of the second moveable clamping element and the width of the first gap in the open position.

5. The epilator in accordance with claim 2, wherein the first and second clamping units form discrete protruding portions of the perimeter of the clamping cylinder.

6. The epilator in accordance with claim 5, wherein a length of the first clamping section of the fixed clamping element, a length of the clamping section of the first moveable clamping element, a length of the second clamping section of the fixed clamping element, and a length of the clamping section of the second moveable clamping element measured in a direction perpendicular to the longitudinal axis of the clamping cylinder is in a range between about 8% and about 12% of the perimeter of the clamping cylinder.

7. The epilator in accordance with claim 6, further comprising a plurality of additional funnels, each having a respective open position, wherein each of the first and second funnels and the plurality of additional funnels have a total width in their respective open position, wherein the sum of the total widths of all funnels is above 100% of an effective width of the clamping cylinder.

8. The epilator in accordance with claim 2, wherein the first and second clamping units have outer surfaces that lie on the surface of an imaginary enveloping cylinder.

9. The epilator in accordance with claim 2, wherein the first and second clamping units are arranged on the clamping cylinder rotating around an axis of rotation and wherein the first and second moveable clamping elements are moveable in a direction perpendicular to a hair capture direction or in a direction parallel with said axis of rotation.

10. The epilator in accordance with claim 2, further comprising a plurality of additional clamping units, each one of the plurality of clamping units having a gap formed between a respective fixed clamping element and a movable clamping element, wherein the first and second clamping units and the plurality of additional clamping units are arranged on the clamping cylinder such that the widths of the first and second gaps of the first and second clamping units and the gaps of the respective plurality of additional clamping units in their respective open positions cover less than 100% of an effective width of the clamping cylinder.

11. The epilator in accordance with claim 2, wherein a total effective width over which the first clamping unit catches hairs is between 2 mm to 7 mm which is the sum of the widths of both adjacent winged sections of the first clamping unit and a width of the first gap between both adjacent clamping sections in its open position; and wherein a total effective width over which the second clamping unit catches hairs is between 2 mm to 7 mm, which is the sum of the widths of both adjacent winged sections of the second clamping unit and a width of the second gap between both adjacent clamping sections in its open position.

12. The epilator in accordance with claim 2, wherein each of the first and second clamping units are arranged to be cyclically movable with a closure velocity between the open and closed positions, wherein each of the first and second clamping units are arranged to be movable at a movement velocity relative to a housing of the epilator, wherein an effective hair catching area of each of the first and second clamping units in relation to the closure time is at least 3500 $mm^2/s$.

13. The epilator in accordance with claim 1, further comprising a fixed wall element; and wherein the winged section of the first moveable clamping element has a free tip and is hinged to the clamping section at an end of the clamping section, the winged section is pre-stressed such that the winged section angularly extends away from the clamping surface of the first moveable clamping element in an unconstrained situation at a predetermined angle, wherein the first moveable clamping element is arranged to be moveable between a first position and a second position and at least the free tip of the winged section is at least during a part of this movement in contact with the fixed wall element causing the winged section to pivot relative to the clamping section such that the angle with which the winged section angularly extends away from the clamping surface is modified at least during the part of the movement during which the free tip of the winged section is in contact with the fixed wall element.

14. The epilator in accordance with claim 1, wherein one or more of the winged section of the first moveable clamping element angularly extends away from the clamping section of the first moveable clamping element at an angle of about 30 degrees or lower, the first winged section of the fixed clamping element angularly extends away from the first clamping section of the fixed clamping element at an angle of about 30 degrees or lower, the winged section of the second moveable clamping element angularly extends away from the clamping section of the second moveable clamping element at an angle of about 30 degrees or lower, and the second winged section of the fixed clamping element angularly extends away from the second clamping section of the fixed clamping element at an angle of about 30 degrees or lower.

15. The epilator in accordance with claim 1, wherein one or more of the first clamping section, the first winged section, the second clamping section, the second winged section, the clamping section of the first moveable clamping element, the winged section of the first moveable clamping element, the clamping section of the second moveable clamping element, and the winged section of the second moveable clamping element comprises an outermost arc shaped portion.

16. The epilator in accordance with claim 1, wherein a length of the first winged section of the fixed clamping element measured along a hair capture direction is larger than a respective length of the winged section of the first moveable clamping element; and wherein a length of the second winged section of the fixed clamping element measured along the hair capture direction is larger than a respective length of the winged section of the second moveable clamping element.

17. The epilator in accordance with claim 1, wherein the clamping cylinder is arranged for rotation around its longitudinal cylinder axis, wherein at least a part of a lower level surface of the clamping cylinder that is not intended for contacting the skin of a user during operation either comprises a regular structuring or an increased friction coefficient with respect to hair.

18. The epilator in accordance with claim 1, where the clamping cylinder comprises ridges, where the ridges have a radial height of in the range of between 0.05 mm to about 0.5 mm.

19. The epilator in accordance with claim 1, wherein the winged section of each of the first and second moveable clamping elements has a three-dimensional shape.

* * * * *